United States Patent [19]

Goulding

[11] Patent Number: 4,709,877

[45] Date of Patent: Dec. 1, 1987

[54] DEPLOYMENT AND ACTUATION MECHANISMS

[75] Inventor: Kenneth Goulding, Stevenage, England

[73] Assignee: British Aerospace PLC, London, England

[21] Appl. No.: 849,945

[22] Filed: Apr. 9, 1986

[51] Int. Cl.[4] ..... F42B 15/027; F16H 1/00

[52] U.S. Cl. ..... 244/3.28; 74/411.5; 74/425; 74/89.14; 244/49

[58] Field of Search ..... 244/3.22, 3.28, 3.29, 244/49; 74/425, 411.5, 89.14, 89; 15/250.16

[56] References Cited

U.S. PATENT DOCUMENTS

| | | | |
|---|---|---|---|
| 3,098,445 | 7/1963 | Jackson | 244/3.28 |
| 3,688,334 | 9/1972 | Peterson | 15/250.16 |
| 4,028,950 | 6/1977 | Osterday | 15/250.16 |
| 4,323,208 | 4/1982 | Ball | 244/3.28 |
| 4,560,121 | 12/1985 | Terp | 244/322 |
| 4,575,025 | 3/1986 | Sadvary et al. | 244/3.27 |

FOREIGN PATENT DOCUMENTS

| | | | |
|---|---|---|---|
| 2150092 | 6/1985 | United Kingdom | 244/3.29 |

*Primary Examiner*—Deborah L. Kyle
*Assistant Examiner*—Michael J. Carone
*Attorney, Agent, or Firm*—Cushman, Darby & Cushman

[57] ABSTRACT

A mechanism for rotating a missile control surface 6 about an axis 26 from the illustrated stowed position within the missile to a deployed position in which it extends radially from the missile axis M—M and for then turning the surface about radial axis 13 so as to steer the missile. A single drive motor 22 is coupled by worm 20 to a bevel gear 18 mounted in a bracket 12, the bracket being turnable about axis 13 with respect to a fixed support 10. The control surface 6 is fixed via arm 23 to a bevel gear 24, which gear is mounted to the bracket 12 for rotation about axis 26 and is engaged with gear 18. While the surface 6 is stowed, a sprung locking pin 14 carried by the bracket 12 is held in engagement with support 10 by gear 18 so that rotation of the motor 22 rotates gear 18 with respect to bracket 12 and hence rotates gear 24 along with arm 23 and control surface 6 about axis 26. When the surface so comes to its deployed position, a hole 25 in gear 18 becomes aligned with pin 14 and the pin moves into the hole so fixing gear 18 with respect to the bracket. Rotation of the shaft of motor 22 then produces rotation of bracket 12, gear 18 and surface 6 about axis 13.

The mechanism can be used in other situations where it is required to erect a member from a stowed position to one of a range of operative positions and to then move the member within that range.

5 Claims, 10 Drawing Figures

Fig. 3.
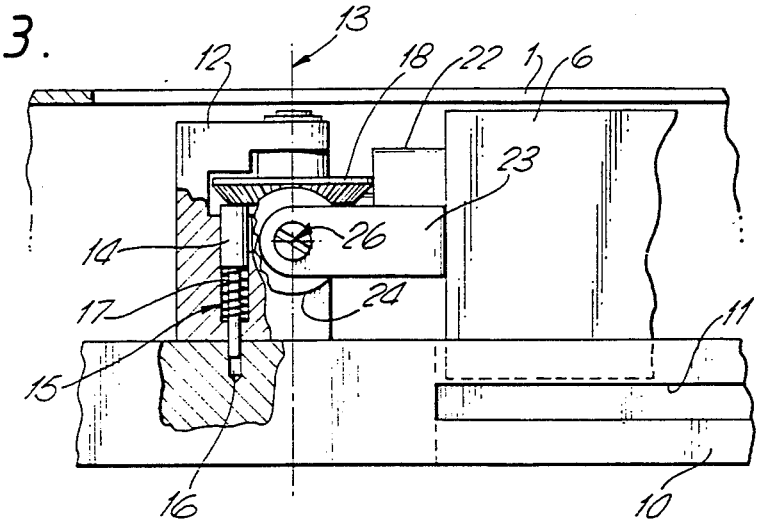
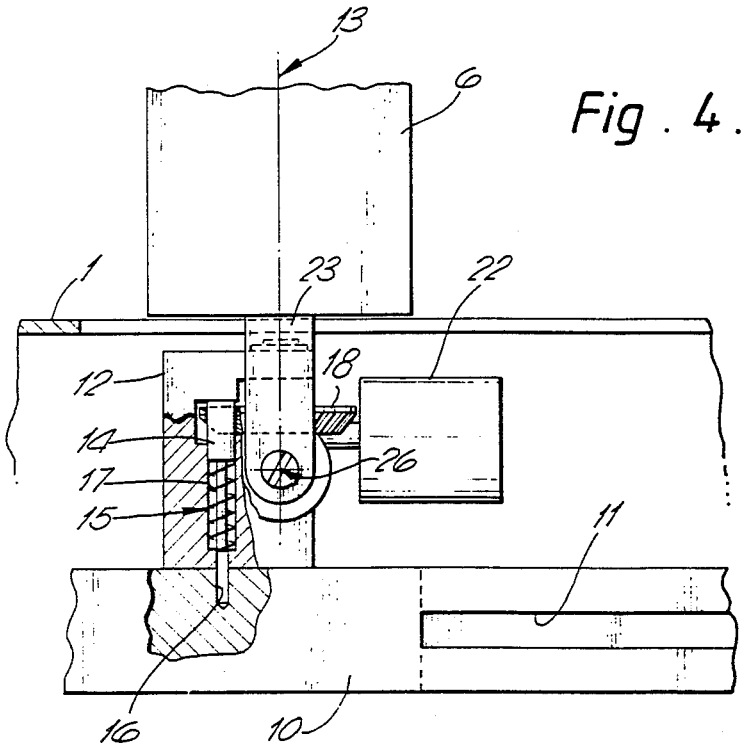
Fig. 4.

DEPLOYMENT AND ACTUATION MECHANISMS

This invention relates to a mechanism for erecting a member from an initial stowed position to one of a range of operative positions and for then moving the member within said range, and is more particularly, although not exclusively, concerned with a mechanism for the deployment and actuation of a missile control surface, for example, a steering fin or wing.

According to one aspect of the present invention, there is provided a mechanism for erecting a member from an initial stowed position to one of a range of operative positions, and for then moving the member within said range, the mechanism comprising a support structure operable for supporting said member for movement with respect to the support structure, a drive motor connected to said support structure and having a movable output element, adaptive coupling means for coupling said motor output element to said member and operable whilst the member is at said stowed position and between said stowed and operative position for translating movement of said motor output element to produce said erection of said member and which becomes operable when the member is erected for translating movement of said motor output element to produce movement of said member within said range of operative positions.

Preferably, said adaptive coupling comprises:

a first rotatable element supported by said support structure and able to turn with respect to the support structure about a first axis, a second rotatable element support by said first rotatable element and turntable with respect to the first rotatable element about said first axis, and locking means for locking said first rotatable element with respect to the support structure and for locking said second rotatable element with respect to the first element, said member being supported by the first rotatable element and being turnable with respect to the first rotatable element about a second axis transverse to the first axis between said stowed and erected positions, the output element of the drive motor being arranged to apply a turning moment about said first axis to the second rotatable element and the member being coupled to said second rotatable element such that, with the first element locked to said support structure by the locking means, said turning moment causes the second rotatable element to turn with respect to the first rotatable element and the member to be turned about said second axis and, with the first rotatable element unlocked from the support structure but instead locked by the locking means to the second element, said turning moment causes the first and second rotatable elements and the member to turn together about said first axis with respect to the support structure.

Advantageously, said second rotatable element is a gear-toothed element and said drive motor and said member are coupled to the gear-toothed element by way of respective gears.

The locking means may comprise a locking pin supported by the first rotatable element and spring means for urging the pin to move towards the second rotatable element, the support structure having a hole in it which, in one relative position of the support structure and first rotatable element, is able to receive one end of the pin, and the second rotatable element having a hole into which, when it is aligned with the pin, the pin is urged to move by the spring means, said one end of the pin thereby coming out of engagement with the hole in the support structure. The support structure may have an arcuate slot formed in it which extends to each side of the hole, said one end of the pin remaining engaged within said slot when the pin moves into engagement with the second rotatable member so as to then limit the range of movement of the first rotatable member with respect to the support structure.

According to a second aspect of the invention, there is provided a missile comprising a mechanism as described above, arranged to deploy and actuate a control surface of the missile.

For a better understanding of the invention, reference will now be made, by way of example, to the accompanying drawings in which:

FIG. 3 is a part sectional side elevation of the FIG. 2 mechanism showing the position of a pin and spring arrangement within the mechanism with the canard in the stowed position;

FIG. 4 is the same as FIG. 3 but with the canard in its erected position;

Figure 5:
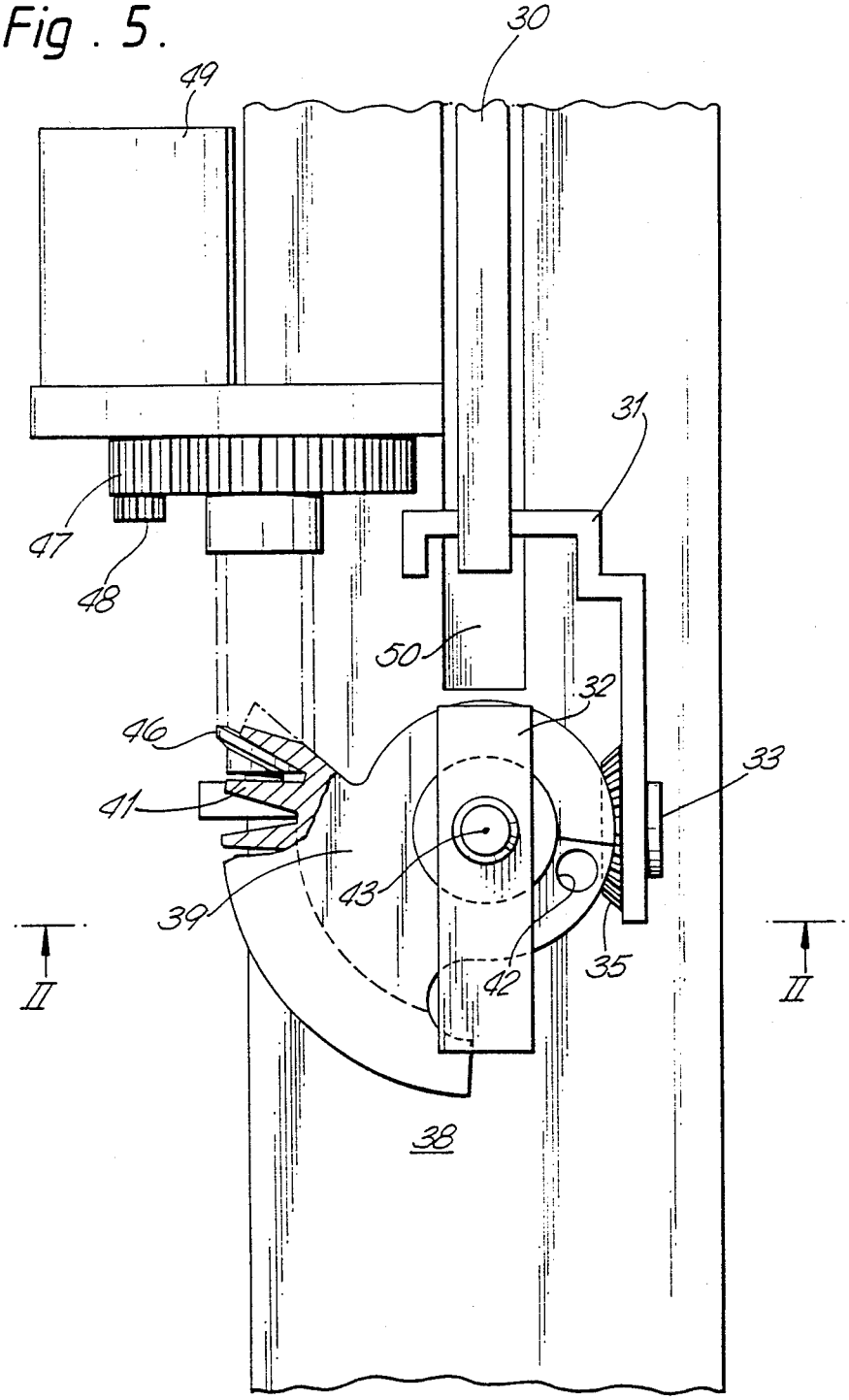
FIG. 5 is a plan view of another control surface erection and actuation mechanism.
Figure 6:
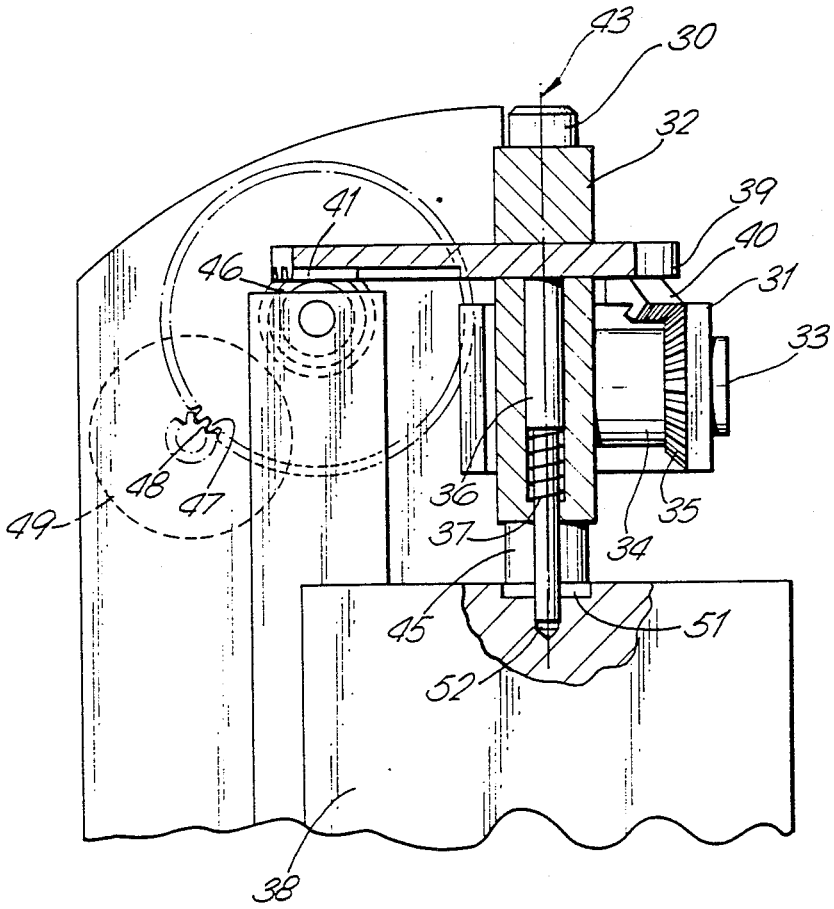
FIG. 6 is a section on line II—II of FIG. 5.

FIGS. *7a* and *7b* each comprise a sectional view of part of a missile comprising a canard control surface to be erected and actuated by the FIG. 5 mechanism, the respective figures showing the canard in its stowed and erected positions; and FIGS. *8a* and *8b* are respectively a plan and an elevation of a worm wheel used in the FIG. 5 mechanism.

Figure 1:
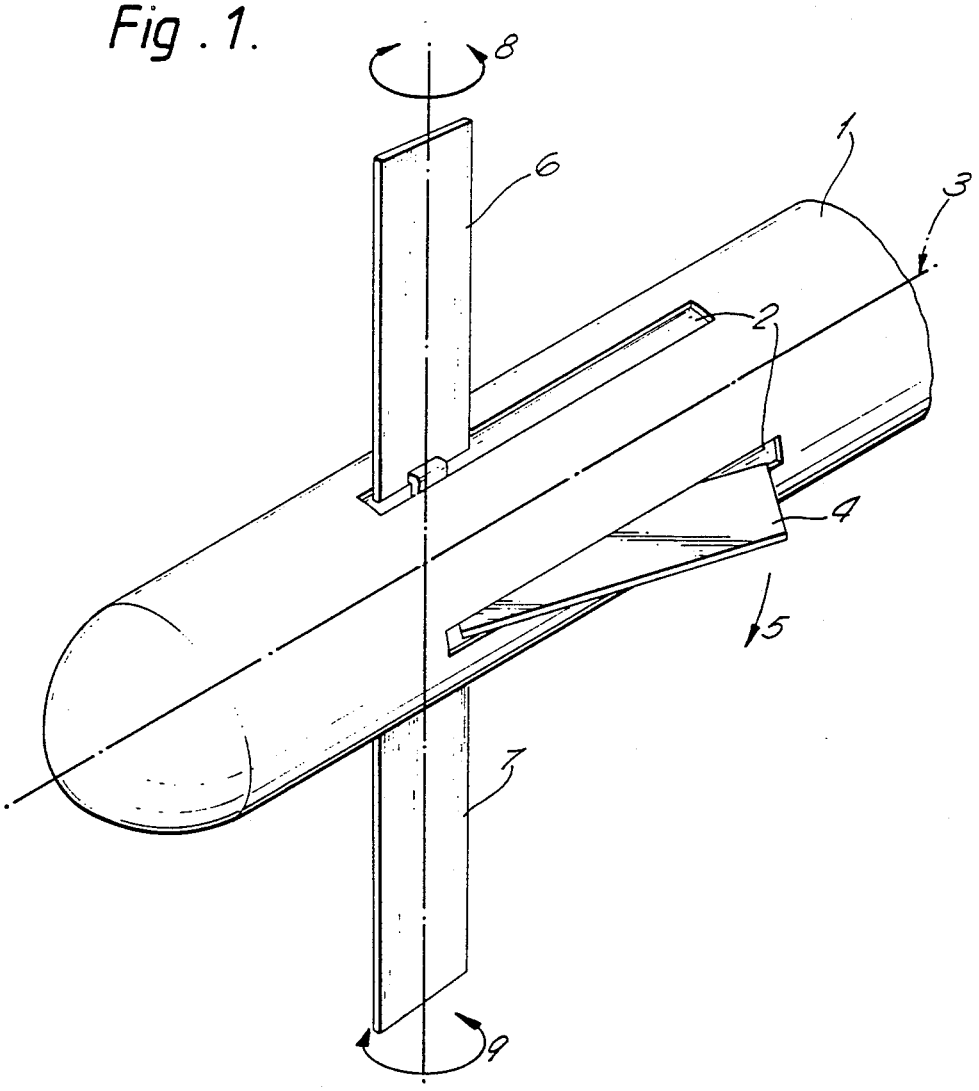
FIG. 1 is a schematic representation of a portion of a missile having canard control surfaces.

The FIG. 1 missile comprises a body 1 and, to control the flight of the missile, four canards (only three of which can be seen) which are initially stowed within the missile body 1 but which, when they are to become operative, are swung out through respective slots 2 until they extend generally radially outwardly from the body axis 3. In the figure, the canard 4 is shown on its way, in the direction of arrow 5, from its stowed to its operative position. Meanwhile, the canards 6 and 7 are fully extended. In the fully extended position, each canard is rotatable in either direction about respective axes extending radial to axis 3 as shown by arrows 8 and 9, to control the missile flight.

Figure 2:
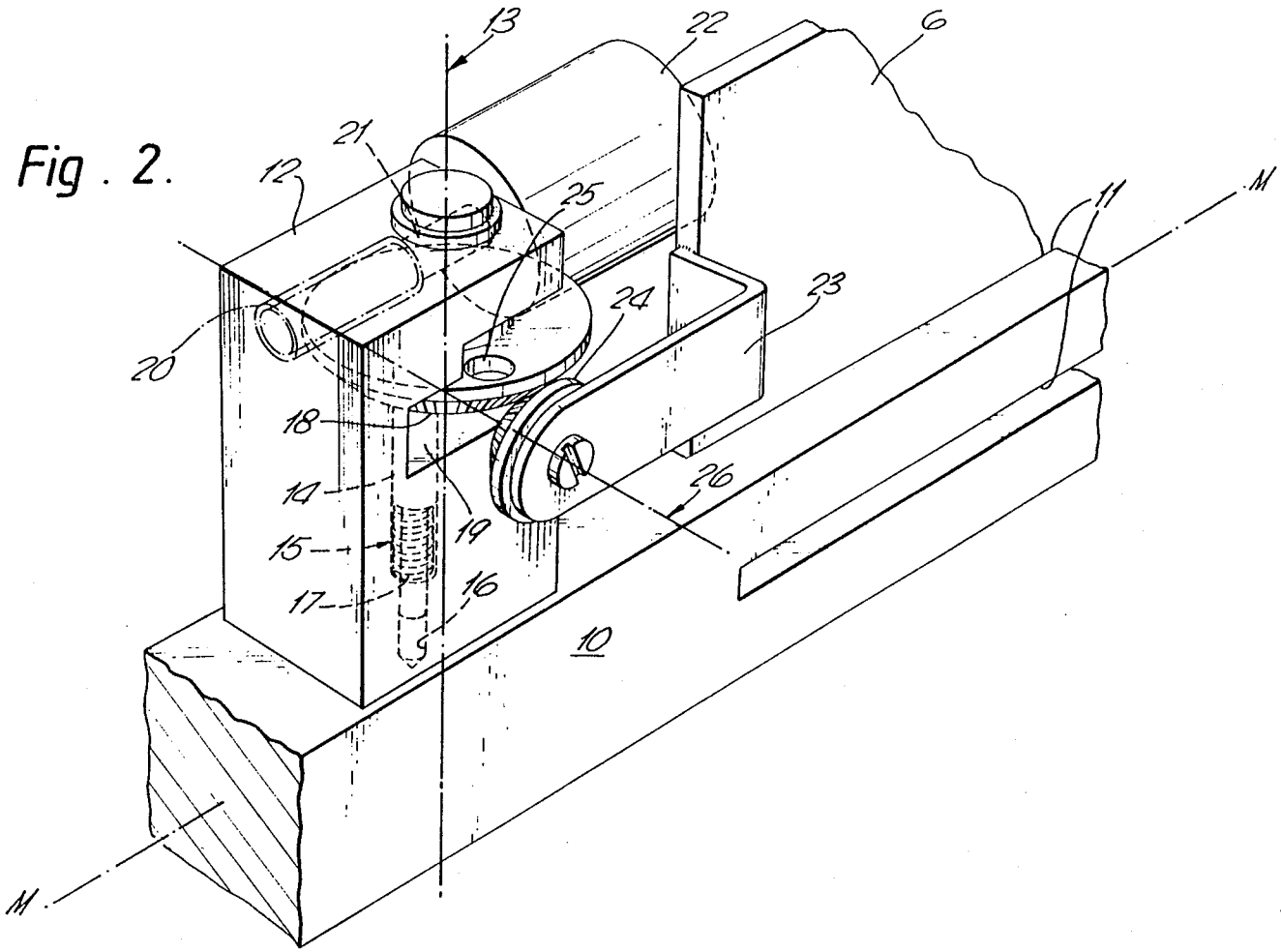
FIG. 2 is a perspective view of a canard erection and actuation mechanism used in the FIG. 1 missile.

As shown in FIGS. 2 and 3, there extends along the central axis of the missile body in the region of the canards, an elongate support member 10 having a square cross-section. Each face of the member 10 supports a respective one of the canards along with a drive mechanism for extending the canard and rotating it when it is in its extended position. In FIGS. 2 and 3, only the canard 6 of FIG. 1 and its associated drive mechanism are shown. This canard is in its stowed position lying along the member 10 and partly entered into a corresponding one of four grooves or slots 11 formed in the respective faces of the member 10.

The drive mechanism comprises a mounting block 12 which is pivotably supported by the member 10 so that it can turn about axis 13 with respect to the member 10. However while the canard 6 is in its stowed position as shown, this turning movement is prevented by a pin 14 carried in a hole extending parallel to but spaced from axis 13 and maintained in engagement with a hole 16 in member 10, against the force of a loading spring 17, by a face of a bevel gear wheel 18. The gear wheel 18 is mounted for rotation about axis 13 in a recess 19 formed in the block 12 and is engaged with a worm gear 20 connected to the output shaft 21 of a motor 22. The motor 22 is supported by lugs (not shown) extending up from the member 10.

One end of the canard 6, i.e. the end which will be nearest to the missile body 1 when the canard is extended, is attached to an angle-bracket 23 which extends to alongside the block 12 and is connected to a bevel gear 24. The gear 24 is engaged with gear wheel 18 and is connected to block 12 such that when driven by the motor 22 via worm 20 and gear wheel 18, the gear 24, along with the bracket 23 and the canard 6 can turn with respect to the block 12 about an axis 26 perpendicular to axis 13 i.e. so that the canard can turn to reach its extended position.

As the canard reaches its extended position a hole 25 formed in the gear wheel 18 comes into registry with the pin 14 whereupon the pin is forced out of engagement with the hole 16 and into engagement with hole 25 by the spring 17 as shown in FIG. 4. Thus, the gear wheel 18 now becomes locked to the block 12 while the block 12 becomes free to rotate about axis 13, driven by motor 22 via worm 20 and gear wheel 18, with respect to the support member 10. The canard 6 is meanwhile maintained in its extended position by the engagement of gears 18 and 24 and it rotates about axis 13 along with the block 12.

FIGS. 5 to 8 show a second embodiment of the invention wherein a triangular steering canard 30 (shown most clearly in FIGS. 7*a* and 7*b*) is pivotably attached to a bracket 31 which is pivotably mounted to a mounting block 32 by a screw 33, the screw 33 passing through the bracket 31 and a spacer 34 into the block 32. On the inside of the bracket 31, adjacent spacer 34, is a bevel gear 35. A pin 36 mounted on a spring 37 within the block 32 can lock the block 32 to a support member 38 carried within the missile body or to a worm wheel 39, according to the position of the wheel 39. As shown in FIGS. 8*a* and 8*b*, the worm wheel 39 has a bevel gear portion 40, a worm gear portion 41 and a hole 42. It is mounted so that it is free to move within the block 32 (providing the pin 36 is not locking the wheel 39 to the block 32), rotating about an axis 43 which passes through the block 32, the wheel itself and a further spacer 45 into the member 38. A worm 46 engages with the worm gear portion 41, and is attached to a spur gear 47. The gear 47 engages with another spur gear 48 which is mounted on a drive motor 49. When the canard 30 is retracted it lies partly in a slot 50 in the member 38. A slot 51 and a hole 52 are also provided in the member 38.

While the canard 30 is retracted, the pin 36 locks the block 32 to the member 38—the wheel 39 keeps the pin 36 engaged in the hole 52 compressing the spring 37. This prevents any rotational movement of the block 32 relative to the member 38 around the axis 43. When the canard 30 is to be deployed, the motor 49 drives the gear 48 which engages with the gear 47. Because the gear 47 is connected to the worm gear 46, the drive from the motor 49 is transmitted to the wheel 39 via the worm gear 46 and the worm gear portion 41 which engages with it. The wheel 39 rotates about the axis 43, thereby transmitting the drive from the motor 49 to the bevel gear 35 via the bevel gear portion 40. Rotation of gear 35 is accompanied by rotation of the bracket 31, and hence movement of the canard 30 from its stowed to its operative position.

Figure 7A:
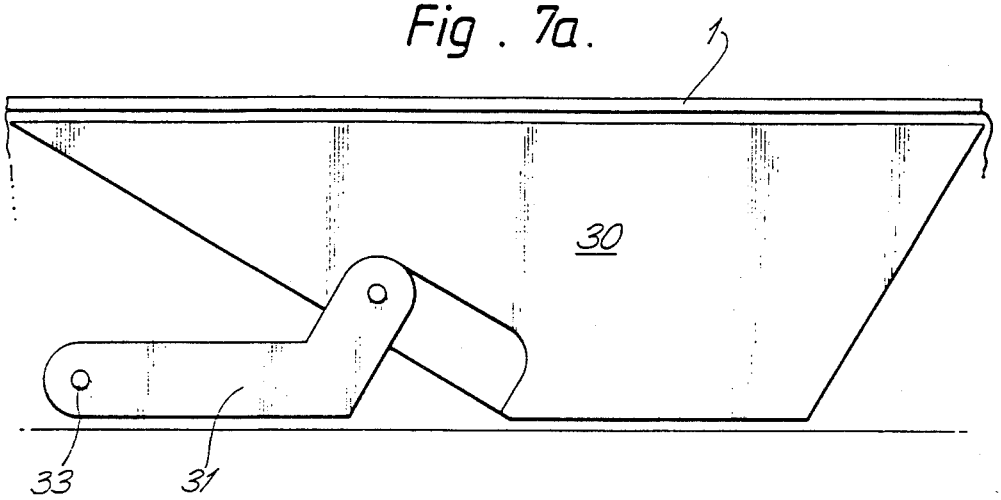
Figure 7B:
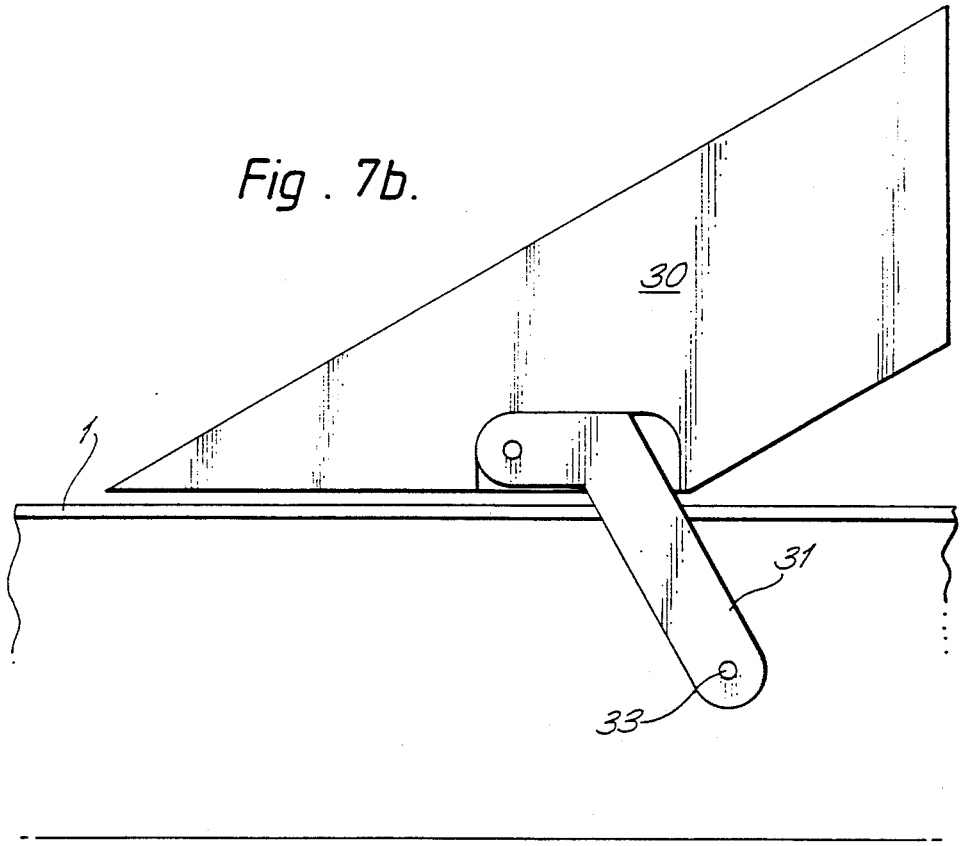
Figure 8A:
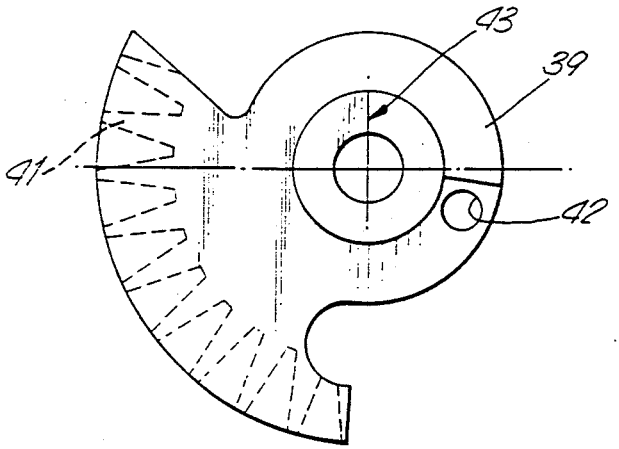
Figure 8B:
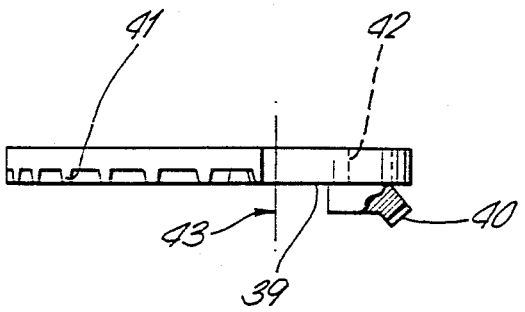

As the canard 30 becomes fully erected as shown in FIG. 7*b*, the hole 42 in the wheel 39 comes into coincidence with the top of the pin 36. The spring 37 then forces the pin 36 upwards out of the hole 52 and into the hole 42 so locking the wheel 39 to the block 32 while freeing the block 32 for movement about axis 43. The lower end of the pin 36 does not completely clear the member 38 but is free to move in the slot 51 which extends to an arc either side of the hole 52 in the member 38. Thus, the drive from the motor 49 is now effective via gears 48 and 47, the worm 46 and wheel 39, to rotate the block 32 along with the canard 30 about the axis 43 within the limits set by the ends of slot 51. The canard 30 can be rotated about axis 43 either in a clockwise or an anticlockwise direction depending on the direction of rotation of the motor 49.

The spacers 34 and 45 may be formed as an integral part of the block 32.

As will be realised, the illustrated mechanisms could be used to deploy and actuate types of missile control surface other than canards, eg. fins and wings, or could be used in many situations, not necessarily in relation to missiles, where some member is to be deployed from a stowed to one of a range of operative positions and then moved within that range.

It will also be realised that the term 'missile' as used herein includes not only guide missiles but also various other types of weapon, for example bombs, shells, rockets, mortar bombs and perhaps even torpedos and depth charges.

I claim:

1. A mechanism for erecting a member from an initial stowed position to one of a range of operative positions by turning movement about a first axis, and for then moving the member within said range by turning movement about a second axis arranged at an angle other than zero with respect to said first axis, the mechanism comprising a support structure operable for supporting said member for movement with respect to said support structure, a drive motor connected to said support structure and having a movable output element, means coupling said motor output element to said member and operable whilst said member is at said stowed position and between said stowed and operative positions for translating movement of said motor output element to produce said erection of said member and which becomes operable when said member is erected for translating movement of said motor output element to produce movement of said member within said range of operative positions.

2. A mechanism according to claim 1, wherein said coupling means comprises:

a first rotatable element supported by said support structure and able to turn with respect to said support structure about a fixed axis, a second rotatable element supported by said first rotatable element and turnable with respect to said first rotatable element about said first axis, and means for alternately locking and unlocking said first rotatable element with respect to said support structure and unlocking and locking said second rotatable element with respect to said first element, said member being supported by said first rotatable element and being turnable with respect to said first rotatable element about a second axis transverse to said first axis between said stowed and erected positions, the output element of the drive motor being arranged to apply a turning moment about said first axis to said second rotatable element and said member being coupled to said second rotatable element such that, with said first element locked to said support structure by said locking means, said turning moment causes said second rotatable element to turn with respect to said first rotatable element and said member to be turned about said second axis and, with said first rotatable element unlocked from said support structure but instead locked by said locking means to said second element, said turning moment causes said first and second rotatable elements and said member to turn together about said first axis with respect to said support structure.

3. A mechanism according to claim 2, wherein said second rotatable element is a gear-toothed element and said drive motor and said member are coupled to said gear-toothed element by way of respective gears.

4. A mechanism according to claim 2 or 3, wherein the locking means comprises a locking pin supported by the first rotatable element and spring means for urging said pin to move towards the second rotatable element, the support structure having a hole in it which, in one relative position of said support structure and said first rotatable element, is able to receive one end of said pin, and said second rotatable element having a hole into which, when it is aligned with said pin, said pin is urged to move by said spring means, said one end of said pin thereby coming out of engagement with said hole in said support structure.

5. A mechanism according to claim 4, wherein the support structure has an arcuate slot formed therein extending each side of the hole, said one end of the pin remaining engaged within said slot when said pin moves into engagement with the second rotatable member so as to then limit the range of movement of the first rotatable member with respect to said support structure.

* * * * *